US005435416A

United States Patent [19]

Siikonen et al.

[11] Patent Number: 5,435,416

[45] Date of Patent: Jul. 25, 1995

[54] DETERMINATION OF THE NUMBER OF PERSONS ENTERING AND LEAVING AN ELEVATOR CAR

[75] Inventors: Marja-Liisa Siikonen, Helsinki; Nils-Robert Roschier, Vantaa, both of Finland

[73] Assignee: Kone Elevator GmbH, Baar, Switzerland

[21] Appl. No.: 203,755

[22] Filed: Mar. 1, 1994

Related U.S. Application Data

[63] Continuation of Ser. No. 929,573, Aug. 14, 1992, abandoned.

[30] Foreign Application Priority Data

Aug. 15, 1991 [FI] Finland ..... 913857

[51] Int. Cl.[6] ..... B66B 1/34

[52] U.S. Cl. ..... 187/392; 187/393

[58] Field of Search ..... 187/130, 131, 132, 138, 187/392, 391, 393

[56] References Cited

U.S. PATENT DOCUMENTS

| | | | |
|---|---|---|---|
| 3,065,823 | 11/1962 | Burgy | 187/29 |
| 3,207,266 | 9/1965 | Hornung | 187/131 |
| 4,044,860 | 8/1977 | Kaneko et al. | 187/29 R |
| 4,330,836 | 5/1982 | Donofrio et al. | 364/567 |
| 4,460,066 | 7/1984 | Ohta | 187/29 R |
| 4,536,842 | 8/1985 | Yoneda et al. | 364/424 |
| 4,573,542 | 3/1986 | Schlegel et al. | 177/132 |
| 5,004,076 | 4/1991 | Chen et al. | 187/130 |
| 5,182,776 | 1/1993 | Suzuki et al. | 382/14 |
| 5,260,527 | 11/1993 | Sirag, Jr. | 187/131 |

FOREIGN PATENT DOCUMENTS

| | | | |
|---|---|---|---|
| 0199015 | 2/1986 | European Pat. Off. . | |
| 528188 | 2/1993 | European Pat. Off. | 187/131 |
| 1278706 | 9/1968 | Germany . | |
| 0070544 | 6/1979 | Japan | 187/131 |

*Primary Examiner*—Thomas M. Dougherty
*Assistant Examiner*—Robert Nappi

[57] ABSTRACT

Procedure for determining the number of passenger transfers in an elevator car on the basis of car load data. The procedure of the invention includes continuous measurement of the car load during stoppage, filtering of the measurement data, recording of the load changes taking place during stoppage, and determination of the number of persons having entered or left the elevator car, based on said changes. The device contains an A/D converter for converting the load data into digital form, and a recording and calculation unit placed in the elevator control system and connected to the output of the A/D converter to detect and count the changes in the load.

19 Claims, 5 Drawing Sheets

FIG. 1
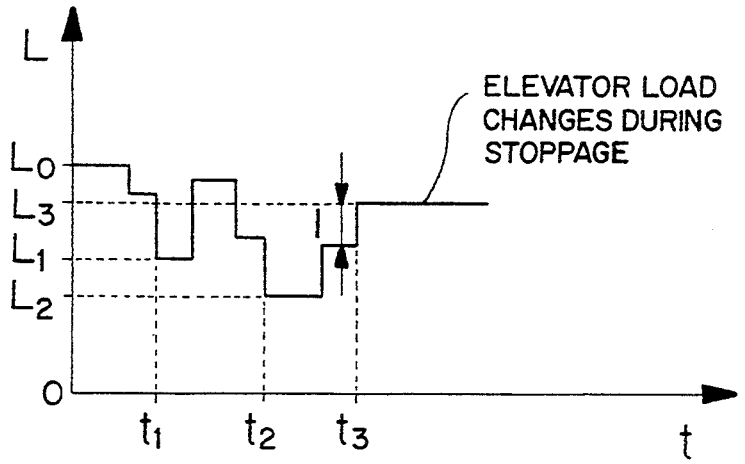
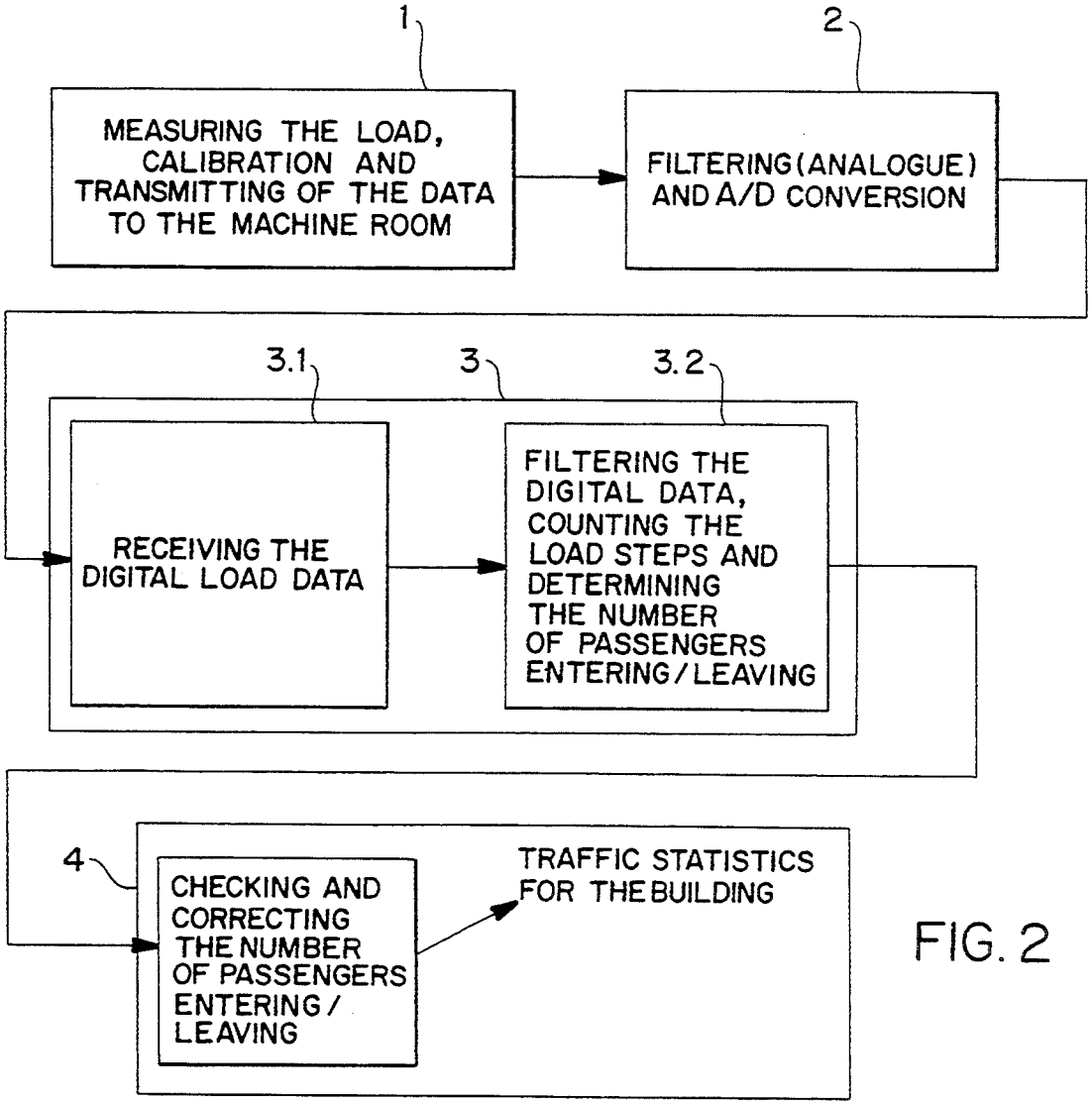
FIG. 2

DETERMINATION OF THE NUMBER OF PERSONS ENTERING AND LEAVING AN ELEVATOR CAR

This application is a continuation of application Ser. No. 07/929,573 filed on Aug. 14, 1992, now abandoned.

FIELD OF THE INVENTION

The present invention relates to a procedure for determining the number of persons entering and leaving an elevator car, based on the load data, and a corresponding apparatus as defined in the introductory part of claim 6.

BACKGROUND

In elevator control systems, besides the data on the load and calls, it is necessary to have data on the number of people in the elevator car in different situations during use. The numbers of passengers can be used, on the one hand, to produce statistics to monitor and enhance the control of the elevator and, on the other hand, to provide current information on the loading of the elevator. Both short-term and long-term statistics are maintained. The numbers of passengers entering and leaving the elevator car are recorded in the statistics separately for each floor and direction as functions of time. The statistics are utilized in the control of the elevator or the associated external devices. In group control, the statistics are used to control the elevators in such a way that the prevailing traffic type and intensity as well as the estimated number of persons behind a call are taken into account. Different floors are served according to the need. It is also possible to consider the prevailing traffic situation in the control of the open times and closing speeds of the doors so that, and the degree of admission of passengers into the car can be optimized. The data on the number of passengers can be used to give better information to the customers about the prevailing situation and to control people's behaviour. The long-term statistics can be used in the development of the activities. In some cases it is also necessary to obtain information on the real traffic over a relatively long period, even 30 days. In prior art, the number of persons moving into and out of an elevator car has been determined using photocells to detect the movement of people or by measuring the load during stoppage. A photocell has a limited power of resolution in peak traffic conditions, especially if passengers move simultaneously in both directions through the doors. Procedures using the load data involve measuring the total load of the elevator at the instants of stopping and departure and the minimum load between those instants. The number of people entering and leaving the elevator car is calculated from these results using an average passenger weight. Thus, the procedure is based on the assumption that all passengers leaving the car get out of it before those entering the car get in, which is not always in keeping with the actual situation. Inaccuracies also result from the differences between the real and the standardized passenger weights.

OBJECTS AND SUMMARY OF THE INVENTION

The object of the present invention is to achieve a new and more accurate procedure and apparatus for determining the number of persons entering and leaving an elevator car. According to the invention, the load of the elevator car is measured continuously during stoppage and the changes detected are utilized to determine the number of people entering and leaving the car. In this way, the load data, which is needed in any case, can be utilized without adding separate measuring equipment.

The load data is preferably measured in analog form and then converted into digital form. To prevent interference, the load data is filtered digitally. The result obtained can then be checked by means of results obtained by other methods.

As compared to previously known methods, the invention provides more accurate data on the movements of passengers in different load and traffic conditions. The weighing equipment installed in the elevator car for other purposes can be used directly to obtain the measurement results, so the solution is economically advantageous. If necessary, new weighing equipment can be installed in old elevators in connection with modernization. According to the invention, the real changes in the number of passengers are determined without approximate calculations.

These and other objects of the present invention will become more readily apparent from the detailed description given hereinafter. However, it should be understood that the detailed description and specific examles, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein FIG. 1 represents the changes in the load of an elevator during stoppage, FIG. 2 is a diagram illustrating the processing of the load measurement data in the procedure of the invention.

DETAILED DESCRIPTION OF PREFERRED EMBODIMENTS

During stoppage, the load of an elevator car varies e.g. as shown in FIG. 1. At the instant of stopping ($t=0$), the car carries a load of $L_0$, which decreases in a stepwise manner to the value $L_1$ at instant $t=t_1$ as two persons leave the car. After that, one person enters the elevator and two leave it. The minimum load $L_2$ during the stoppage prevails at instant $t=t_2$. After two more people enter the car, the load increases in a stepwise manner to the value $L_3$ at the instant $t=t_3$ of termination of the stoppage at the floor in question.

In a previously known method for determining on the basis of load data the numbers $Pass_{out}$ and $Pass_{in}$ of persons entering and leaving an elevator car, the extreme values L0, L2, L3 of the load are used and the numbers of persons are calculated using the following formulas for approximate values:

$$Pass_{out}=(L_0-L_2)/80\ kg\approx 3\ persons$$

$$Pass_{in}=(L_3-L_2)/80\ kg\approx 2\ persons$$

According to the invention, the load data is measured continuously during the whole time the elevator stands at a floor, allowing each stepwise load change 1 to be determined. Based on the number and direction of the changes, the numbers $Pass_{in}$ and $Pass_{out}$ of passengers entering and leaving the elevator can be calculated. In the case presented in FIG. 1, these numbers can be accurately determined, i.e. $Pass_{in}=3$ and $Pass_{out}=4$. The passengers may enter or leave the elevator in any order without essentially affecting the accuracy. As each change in the load is treated individually, the procedure provides real information about the number of passengers. Therefore, weight differences between passengers and deviations in their order of entering/leaving will not produce errors in the result.

FIG. 2 presents a diagram illustrating the measurement of the load of an elevator car and the processing of the measurement signal in the procedure of the invention. The load in the car is measured in block 1. The measurement can be performed by measuring the weight of the car and its load by means of sensors placed under the car. This provides the most accurate load data. Alternatively, it is possible to use a weighing device mounted on the safety gear frame, in which case the measurement result includes the weight of the car frame and car cables as well. This solution is advantageous when the procedure of the invention is applied to old elevators as it makes it unnecessary to dismantle the car structures.

The signal obtained from the car load measurement is passed via conductors to the machine room housing the control panels of the elevators. The load measurement range typically varies between 0–130% of the rated load. The measurement signal is filtered and converted into digital form by an A/D converter in block 2. The digital data indicates the load as a percentage of the rated load with an accuracy of e.g. eight bits.

Figure 3:
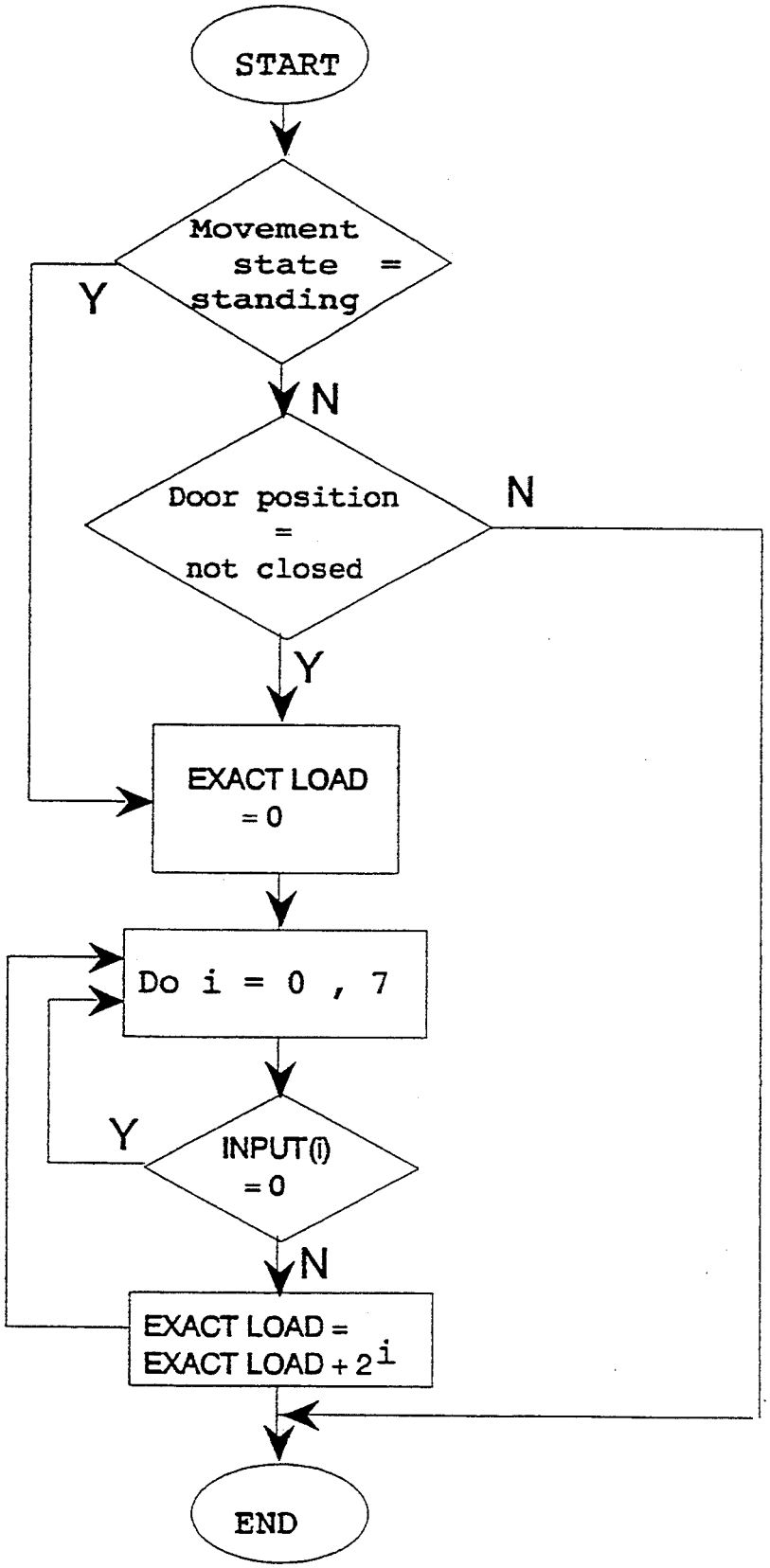
FIG. 3 is a flow diagram representing the recording of the load data.

In the elevator control 3, the load data is recorded in block 3.1. This recording is performed at 100 ms intervals in the manner illustrated by the flowchart in FIG. 3. In the selection blocks of the chart, the state of car movement and the position of the doors are established first. If the elevator car is standing or the doors are open, the load value is set to zero (EXACT LOAD=0). In the loop, the load value is determined from the input connectors one bit at a time.

The digital data is filtered in block 3.2 (FIG. 2) to eliminate any disturbance components that may appear in it. In this way, e.g. the momentary load changes resulting from a person moving in the car can be filtered out. Usable filtering methods are e.g. median filtering, in which only the middle one of the measurement results obtained within a certain period is taken into account, and exponential filtering, in which the most recent result and the results obtained previously are weighted with certain coefficients. Other filtering methods are also possible. From the data filtered in block 3.2, the steps of load change are counted and the entries and exits of passengers are outlined. Thus, the elevator control distinguishes the real load changes resulting from passengers entering or leaving and ignores load signal steps caused by various disturbance factors.

Figure 4:
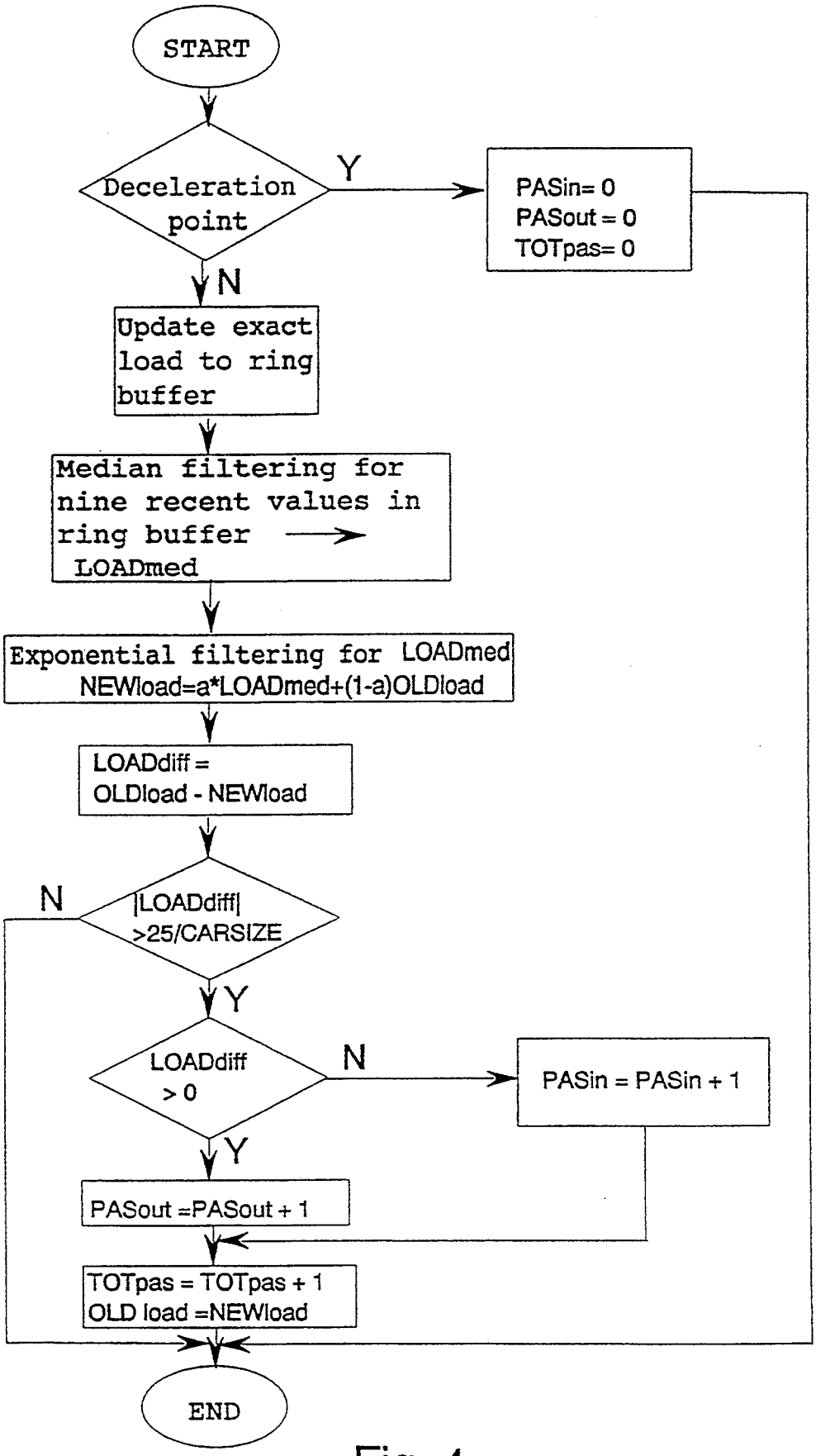
FIG. 4 is a flow diagram representing the calculation of the load.

The flowchart in FIG. 4 shows how the number of persons is calculated by the elevator control. This phase, too, is executed at 100 ms intervals. After the deceleration point, the load data is updated to the ring buffer. Using median filtering, a median load value for the last nine loads is formed, and, further, from the previous calculated load ($OLD_{load}$) and the median load, a new load ($NEW_{load}$) is produced by exponential filtering. The magnitude of the difference ($LOAD_{diff}$) between the old and new load values is calculated and tested. In this example, the difference must be at least one quarter of the average passenger weight while the quantity CARSIZE represents the size of the elevator car in terms of a number of persons. On the basis of the direction of the change, the numbers ($Pass_{in}$ and $Pass_{out}$) of people entering and leaving the car as well as the total number of passengers $Tot_{pas}$ are incremented.

In group control (block 4), using suitable checking devices, the values representing the numbers of persons having entered or left the elevator are monitored and corrected if necessary. Additional data, e.g. car calls, reversals of travelling direction and information obtained from the weighing device or photocells, can be used. If the elevator was stopped at the floor in question by a car call, then it is assumed that at least one person will leave the car during the stoppage. If there was no car call, presumably nobody will leave the car. In the case of a reversal of direction, it is assumed that all passengers will leave the car. The proportions of those entering and those leaving the car are estimated on the basis of the load weight data. It is also possible to consider the size of the load in relation to the calculated number of persons as well as the allowed number of passengers in the car.

Figure 5:
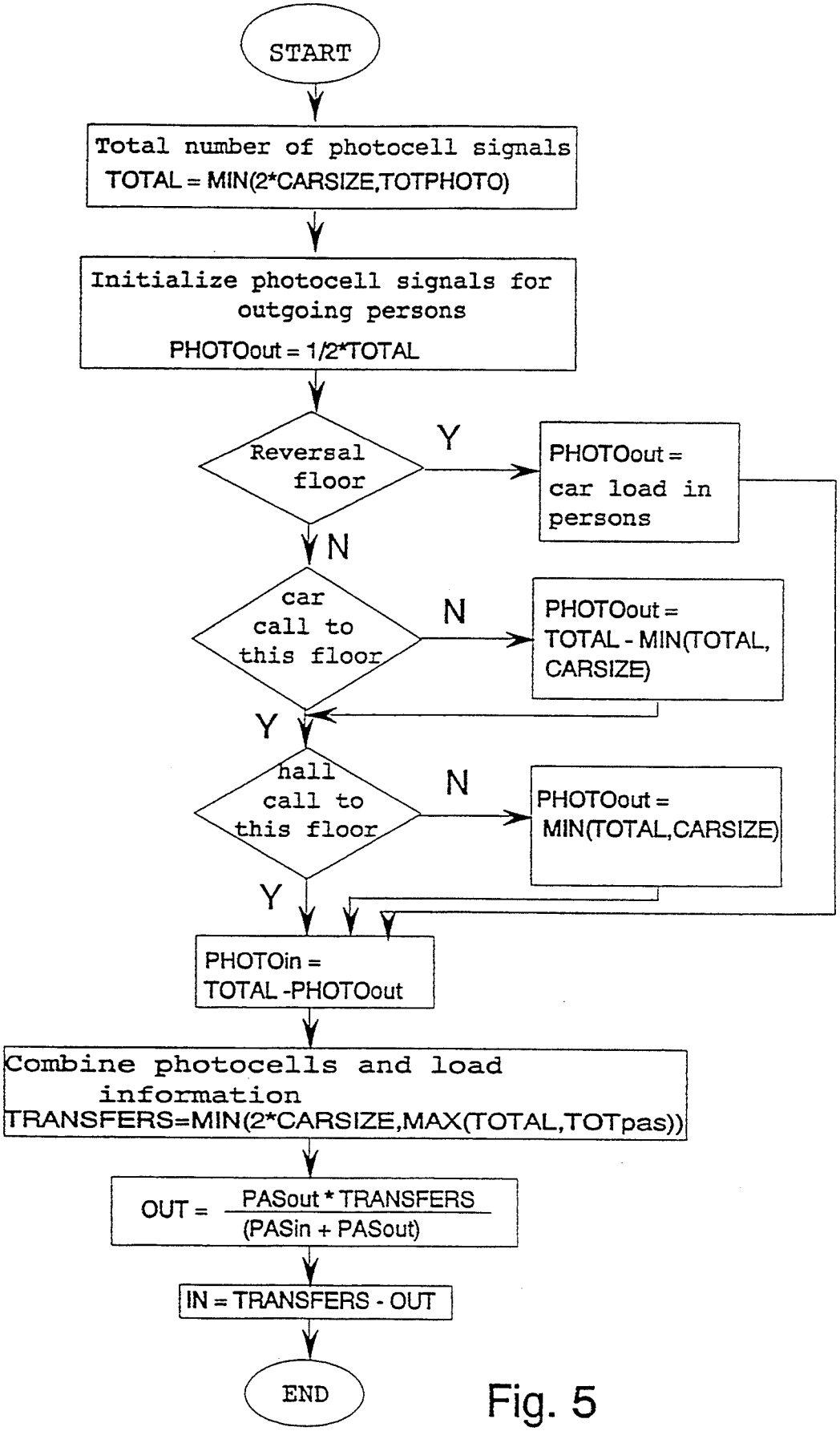
FIG. 5 is a flow diagram representing the verification of the data.

The verification of the data is described by the aid of the flowchart in FIG. 5. The total number of passengers TOTAL obtained by photocell monitoring or counting is determined by selecting the smaller one of the quantities: 2×allowed number of persons in the car (CARSIZE) and total number of photocell signals (TOTPHOTO). The initial value of the number of persons leaving the car ($PHOTO_{out}$) is defined as being equal to half the total number of passengers (TOTAL). In the selection blocks, the value of $PHOTO_{out}$ is adjusted on the basis of floor type, car call data and hall call data. The number of passengers entering the car ($PHOTO_{in}$) is calculated as the difference between the total number of photocell signals TOTAL and the number of outgoing persons $PHOTO_{out}$. Based on the total numbers of persons determined from the photocell and weight data and on the allowed number of passengers for the elevator car, a confirmed total number (TRANSFERS) of passenger transfers (=entries+exits) is produced. The proportion of outgoing persons in this total number is defined as being the same as the proportion of outgoing persons $Pass_{out}$ in the total number $Tot_{pas}$ of passengers moving in or out as determined on the basis of the changes in the weight data. In this way, verified values for the numbers (IN and OUT) of persons entering and leaving the elevator car are obtained.

The numbers of persons obtained after the verification process are utilized in group control and the maintenance of statistics as well as door control.

Figure 6:
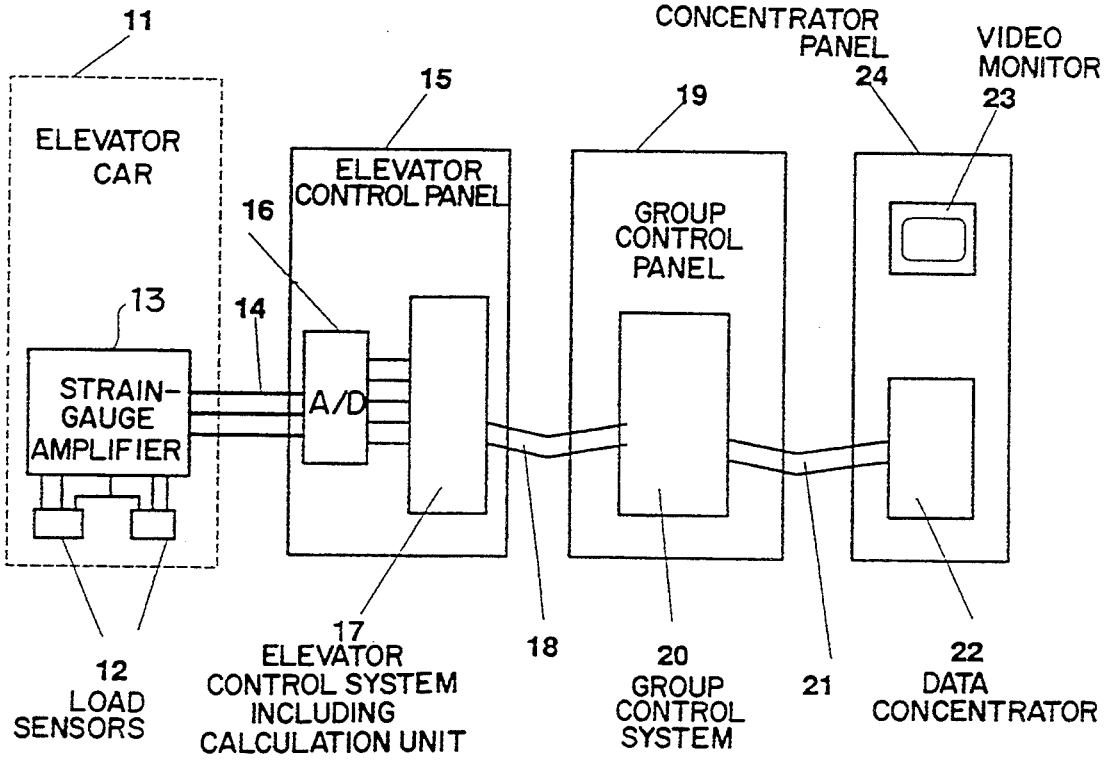
FIG. 6 presents the apparatus of the invention as fitted in an elevator system.

FIG. 6 shows an example of how the apparatus of the invention uses the drive and control equipment of the elevator and how it is fitted into the elevator system.

Placed in the elevator car 11 are load measuring sensors 12 providing a measurement signal which is amplified by a strain-gauge amplifier 13. The amplified signal is passed over conductors 14 to the elevator control panel 15 in the machine room. An A/D converter placed on the DOWI card converts the data obtained from the amplifier 13 into 8-bit binary data for use in the elevator control. For the elevator drive system, the load data is also converted into $-10-+10$ V analog data. In the elevator control system 17, which consists of several control cards, the digital data is recorded at 100 ms intervals. The noise spikes caused by disturbances and random variations are filtered out using digital filtering methods as described in an earlier chapter. The elevator control system 17 also contains a calculation unit used to make the deductions about the numbers of ingoing and outgoing persons.

The data representing the number of persons having entered or left the elevator car is transmitted through a data communication bus 18 to the group control unit 20 in the group control panel 19 at intervals of about 500 ms. At the same time, data on car calls, travelling direction of the elevator, floor and the number of photocell interruptions are transmitted. When an elevator departs from a floor, the group control system 20 generates an event corresponding to a stoppage and performs a verification of passenger transfers. The data representing the current car load are updated via a data communication bus 21 at intervals of about 500 ms to a data concentrator 22 in a concentrator panel 24. The load data and traffic statistics are displayed via a video monitor 23 placed in the concentrator panel 24. The data communication buses 18 and 19 are preferably serial buses.

The invention being thus described, it will be obvious that the same may be varied in many ways. Such variations are not to be regraded as a departure from the spirit and scope of the invention, and all such modifications as would be obvious to one skilled in the art are intended to be included within the scope of the following claims.

We claim:

1. A method of determining passenger transfers into or out of an elevator car when at least two people enter or leave the car, respectively, on the basis of car load data, comprising:

a) continuously measuring car load while doors of the car are open to produce load data;

b) determining, as a function of the load data, significant load change sufficient to identify each of the at least two passengers entering or leaving the elevator car; and c) categorizing, as a function of the load data, each said significant load change as corresponding to a person entering or leaving, respectively;

said method being sufficiently robust so that it is substantially insensitive to an entry/leaving order of passengers.

2. The method of claim 1 wherein said step a) produces analog load data; said method further comprising converting the load data into digital form.

3. The method of claim 2, wherein said step a) of measuring includes step ($a_1$) of filtering digitially the load data to eliminate disturbances.

4. The method of claim 1 further comprising the step of:

d) determining a net number of people entering or leaving the elevator car based upon said categorized significant load changes.

5. The method of claim 4, further comprising verifying the number of people determined by said step d) by using elevator status data including whether a present call is a car call or a hall call and whether a direction of travel of the car is to be reversed when the doors close.

6. The method of claim 4 further comprising verifying the number of people determined by said step d) as a function of photocell measurement of passenger transfers.

7. The method of claim 4 further comprising verifying the number of people determined by said step d) with extreme load data measured substantially while the doors of the car are open.

8. The method of claim 1 further comprising the step of: recording said categorized significant load changes during stoppage.

9. A method as in claim 1, wherein:

said step b) of determining significant load changes is a function of a threshold value.

10. A method as in claim 9, wherein:

said threshold value is is a function of one quarter of a predetermined average passenger weight.

11. A system for categorizing at least two passenger transfers into or out of an elevator car when at least two people enter or leave the car, respectively, on the basis of car load data, said system being sufficiently robust so that a determination is substantially insensitive to an entry/leaving order of passengers, comprising:

a weighing device continuously measuring car load while doors of the car are open to produce load data;

determination means, responsive to said weighing device, for determining, as a function of the load data, significant load change sufficient to identify each of the at least two passengers entering or leaving the elevator car; and categorization means, responsive to said recognition means, for categorizing, as a function of load, each said significant load change as corresponding to a person entering or leaving the elevator car, respectively.

12. The system of claim 11 further comprising:

an A/D converter for digitizing the load data; and a filter connected between the A/D converter and said determination means for eliminating disturbances.

13. A system as in claim 11 further comprising:

recording means, responsive to said categorized significant load changes from said categorization means, for recording said significant load changes, said recording means being included as part of an elevator control system.

14. A system as in claim 11 further comprising:

counting means, responsive to said categorized significant load changes from said categorization means, for counting said significant load changes.

15. The system of a claim 13 wherein said elevator control system is connected to a group control system for controlling a group of elevators via a data communication bus, further comprising:

secondary load information means for providing secondary load information;

said recording means receiving passenger transfer data from said secondary load information means and elevator call direction data from said group control system.

16. The system of claim 15 wherein said secondary load information means includes a photocell detector for detecting the passage of passengers across a door of the elevator car.

17. The system of claim 15 wherein said secondary load information means includs a load signal developed from extreme load data measured during stoppage.

18. A method as in claim 6, wherein:

said determination means recognizes significant load changes as a function of a threshold value.

19. A method as in claim 18, wherein:

said threshold value is a function of one quarter of a predetermined average passenger weight.

* * * * *